US010173801B2

(12) United States Patent
Jain

(10) Patent No.: US 10,173,801 B2
(45) Date of Patent: Jan. 8, 2019

(54) POLYGONAL SHAPED CONTAINER

(71) Applicant: Genex Science and Technologies Pvt. Ltd., Andheri (East), Mumbai (IN)

(72) Inventor: Anil Jain, Mumbai (IN)

(73) Assignee: Genex Science and Technologies Pvt. Ltd., Mumbai (IN)

( * ) Notice: Subject to any disclaimer, the term of this patent is extended or adjusted under 35 U.S.C. 154(b) by 0 days.

(21) Appl. No.: 15/611,810

(22) Filed: Jun. 2, 2017

(65) Prior Publication Data

US 2018/0290784 A1 Oct. 11, 2018

(30) Foreign Application Priority Data

Apr. 8, 2017 (IN) ..... 201721012697

(51) Int. Cl.

| | |
|---|---|
| ***B65D 21/02*** | (2006.01) |
| ***B65D 47/04*** | (2006.01) |
| ***B65D 25/42*** | (2006.01) |
| ***B65D 1/18*** | (2006.01) |

(52) U.S. Cl.

CPC ..... *B65D 1/18* (2013.01); *B65D 21/023* (2013.01); *B65D 25/42* (2013.01); *B65D 47/04* (2013.01)

(58) Field of Classification Search

CPC ..... B65D 21/023; B65D 25/42; B65D 1/18
USPC ..... 222/181.1, 143, 185.1
See application file for complete search history.

(56) References Cited

U.S. PATENT DOCUMENTS 4,516,692 A * 5/1985 Croley ..... B65D 90/046 222/105
4,729,505 A 3/1988 Remaks et al.
4,949,872 A * 8/1990 Heaps, Jr. ..... B65D 77/061 220/495.11
5,226,558 A 7/1993 Whitney et al.
5,232,120 A * 8/1993 Dunken ..... B65D 1/20 206/508
5,375,741 A * 12/1994 Harris ..... B65D 11/10 222/105
6,708,824 B2 * 3/2004 Sahm, III ..... B65D 1/42 206/505
7,059,486 B2 * 6/2006 Van Der Heijden ..... B65D 1/0223 215/379
7,497,332 B1 3/2009 Schwimmer
(Continued)

FOREIGN PATENT DOCUMENTS

EP 2374722 A1 10/2011

*Primary Examiner* — Vishal Pancholi

(57) ABSTRACT

Disclosed is a polygonal shaped container 101. The polygonal shaped container 101 may comprise a top surface 105 a bottom surface 205 and a plurality of side walls 206. Each edge (201, 203) connecting two side walls of the polygonal shaped container 101 may be filled with additional reinforcement material. The additional reinforcement material along with the polygonal shape of the polygonal-shaped container 101 may facilitate in enhancing compressive strength of the polygonal-shaped container 101. One of the side walls 206 may further comprise a discharge valve 202 fixed entirely within a cavity 204 formed on a lower surface of said one of the side walls 206 such that lowest level of a fluid, contained in the polygonal-shaped container 101, may be discharged from the discharge valve 202. The polygonal-shaped container 101 may be capable of being rolled for portability.

8 Claims, 21 Drawing Sheets
(18 of 21 Drawing Sheet(s) Filed in Color)

(56) References Cited

U.S. PATENT DOCUMENTS

| | | | | |
|---|---|---|---|---|
| 8,025,208 | B2 | 9/2011 | Wisecarver et al. | |
| 2009/0159603 | A1* | 6/2009 | Lilico | B65D 1/0292 220/666 |
| 2010/0212351 | A1* | 8/2010 | Chapin | F25D 3/08 62/457.5 |
| 2011/0180556 | A1 | 7/2011 | Lapoint, III et al. | |
| 2016/0237389 | A1* | 8/2016 | Slattery | B65D 77/0466 |

* cited by examiner

POLYGONAL SHAPED CONTAINER

CROSS-REFERENCE TO RELATED APPLICATIONS AND PRIORITY

The present application does claim priority from the Indian patent application number 201721012697 filed on Apr. 8, 2017.

TECHNICAL FIELD

The present subject matter described herein, in general, relates to a field of industrial packaging products. In particular, the present subject matter is related to a polygonal shaped container.

BACKGROUND

A container or a drum or a barrel is a unit of volume which is used in a variety of contexts. The container is basically used for storing or transportation of required material such as fluids, solids etc. Traditionally, the drums or containers or barrels were made up of wood or metal. Selection of the wood or metal for manufacturing the containers was dependent upon the material stored in these containers.

The containers traditionally available were of standard sizes in accordance to a set of capacity or weight of a given commodity. Though these containers were tough by structure, but had several drawbacks. These containers were heavy that would make transportation of these containers difficult as the total weight of the containers during transportation would be the weight of the containers individually plus the weight of the material in it. Moreover, depending on the climate change, metal or wooden containers would undergo expansion, contraction, corrosion etc. This would make such containers less durable. Further, dismantling such containers would also be one of the biggest difficulty. It required quite a lot of human strength to transport such containers.

Presently, a variety of containers are available in market that facilitate a convenient storing or stacking. Still many of them are not flexible for use i.e. deformation in containers is caused in case of accident suffered by these containers. Moreover, the material inside the containers spill out due to such deformations caused which may be in the form of cracks, bends etc. The containers suffer with deformations due to lack of high compression strength. In such a case, stacking and transportation of such containers also is a problem.

Many a times, during transportation of containers with required material stored inside the containers, it may require a couple of days or weeks to reach the destination. In such cases, the material by which the containers are made should not react with the material stored in the drums as the material stored inside the containers may be hazardous, flammable or reactive fluids. For this purpose, it is very necessary that the containers are made of proper material which provide flexibility, durability, high compressive strength, no reaction with the material stored in them and are not prone to deformation in case of accidents.

In some cases, the shapes of containers are usually circular or made of such type of shapes. However, these have less compressive strength and hence when stacked for transportation may be prone to deformation gradually. Further, since majority of the containers available today are made of metal, these are prone to challenges of erosion and rusting. Furthermore, existing containers face challenge of causing contamination due to volatile fluids within the containers as these lacks specific provisions for discharging the material/fluid within the container.

SUMMARY

This summary is provided to introduce concepts related to a polygonal shaped container. This summary is not intended to identify essential features of the claimed subject matter nor is it intended for use in determining or limiting the scope of the claimed subject matter.

In accordance with aspects of the present disclosure, a polygonal-shaped container is described. The polygonal-shaped container may comprise a top surface, a bottom surface, and a plurality of side walls. Each edge connecting two side walls may be filled with additional reinforcement material. The additional reinforcement material along with the polygonal shape of the polygonal-shaped container may facilitate in enhancing compressive strength of the polygonal-shaped container. Further, at least one of the side walls may comprise a discharge valve fixed entirely within a cavity formed on a lower surface of said one of the side walls such that lowest level of a fluid, contained in the polygonal-shaped container, may be discharged from the discharge valve. Furthermore, the polygonal-shaped container may be capable of being rolled for portability.

In an embodiment, the top surface of the polygonal-shaped container may be adapted to hold a bottom surface of an upper container having properties identical to the said polygonal-shaped container and the bottom surface of the polygonal-shaped container may be adapted to be supported on a top surface of a lower container having properties identical to the said polygonal-shaped container thereby facilitating vertical stackability of multiple containers.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

Figure 1:
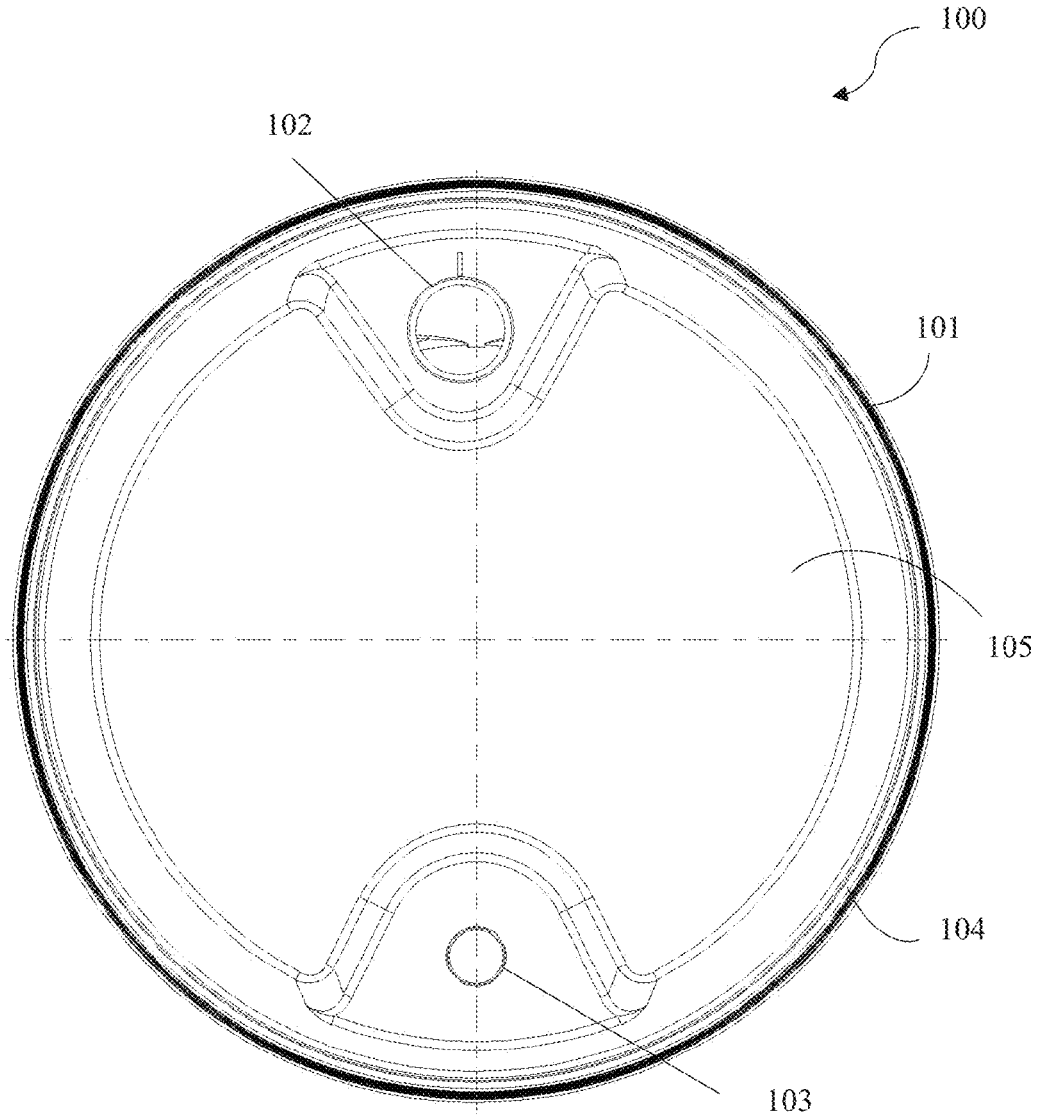
FIG. 1 illustrates a top view 100 of a polygonal-shaped container 101, in accordance with an embodiment of the present subject matter.

Referring now to FIG. 1, a top view 100 of a polygonal-shaped container 101 is illustrated in accordance with an embodiment of the present subject matter. As shown, the polygonal-shaped container 101 may comprise an inlet 102 on an upper surface 105 of the of a polygonal-shaped container 101. The inlet 102 may enable filling of a material and/or fluid in the polygonal-shaped container 101. The fluid may include, but not limited to, petroleum products, paints, oil, hazardous, non-touchable or flammable fluids, and the like. The inlet 102 may have a predefined diameter. The fluid may be filled through the inlet 102 using at least a pipe or a petrol gun, and the like. The polygonal-shaped container 101 may further comprise an opening 103 for discharging of the fluid from the polygonal-shaped container 101 through an external suction means. Therefore, the said opening 103 may be used as an alternative to a discharge valve 202 (shown in FIG. 2). In one embodiment, the polygonal-shaped container 101 may comprise an outer L ring 104. In one embodiment, the polygonal-shaped container 101 may be made of a material including, but not limited to, a polymer material.

Figure 2:
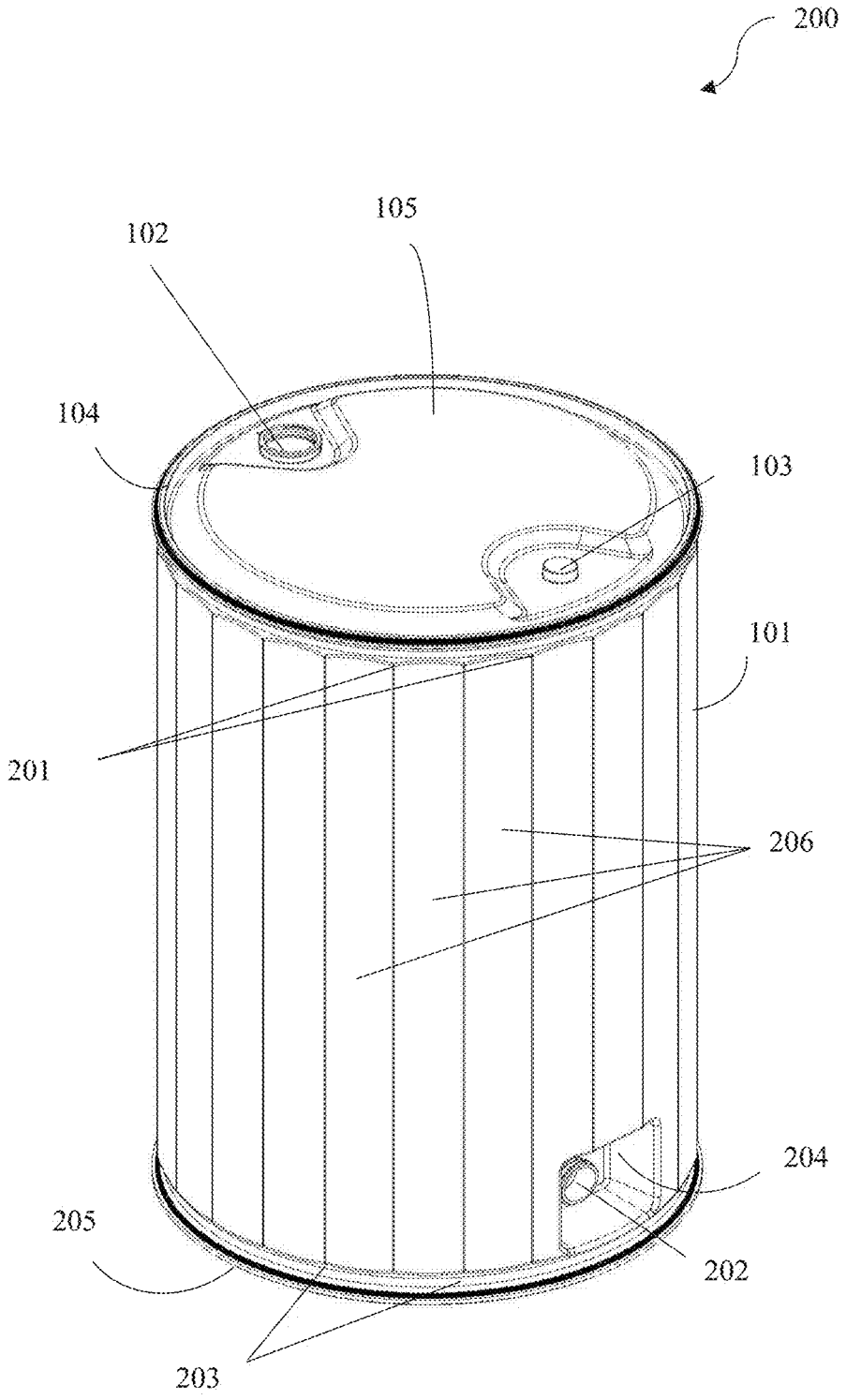
FIG. 2 illustrates a perspective view 200 of the polygonal shaped container 101, in accordance with an embodiment of the present subject matter.

Referring now to FIG. 2, a perspective view 200 of the polygonal-shaped container 101 is illustrated in accordance with an embodiment of the present subject matter. As shown, the polygonal-shaped container 101 may comprise the top surface 105, a bottom surface 205 and a plurality of side walls 206. In an embodiment, each edge (201, 203) connecting two side walls from the plurality of side walls 206 may be filled with additional reinforcement material. The additional reinforcement material along with the polygonal shape of the polygonal-shaped container 101 may facilitate in enhancing compressive strength of the polygonal-shaped container 101. The additional reinforcement material may be adapted to extend from the edge 201 at the upper surface 105 to the edge 203 at the bottom surface 205 of the polygonal-shaped container 101. Such reinforcement may enable forming of a circular shaped inner body of the polygonal-shaped container 101. The inner circular shape of the polygonal-shaped container 101 may facilitate easy cleaning of the inner portion of the polygonal-shaped container 101. The additional reinforcement material may be a polymer material, but may not be limited to said reinforcement material. The polygonal shaped container 101, may be uniform and smooth from inside.

In one embodiment, the top surface 105 of the polygonal-shaped container 101 may be adapted to hold a bottom surface of an upper container wherein said upper container may have properties identical to the said polygonal-shaped container 101. The bottom surface 205 of the polygonal-shaped container 101 may be adapted to be supported on a top surface of a lower container having properties identical to the said polygonal-shaped container 101. Such placement of the polygonal-shaped container 101 may thereby facilitate vertical stackability of multiple containers. In one embodiment, the stackability may be enabled by placing a pallet in between a first stack and a second stack of the polygonal-shaped containers. In one embodiment, said stackability may be enabled by engaging the outer L ring 104 on the upper surface and bottom surface of the polygonal-shaped containers with a stack of said containers. In one embodiment, a connector may be provided to enable relative positioning of plurality of polygonal-shaped containers while stacking.

Figure 3A:
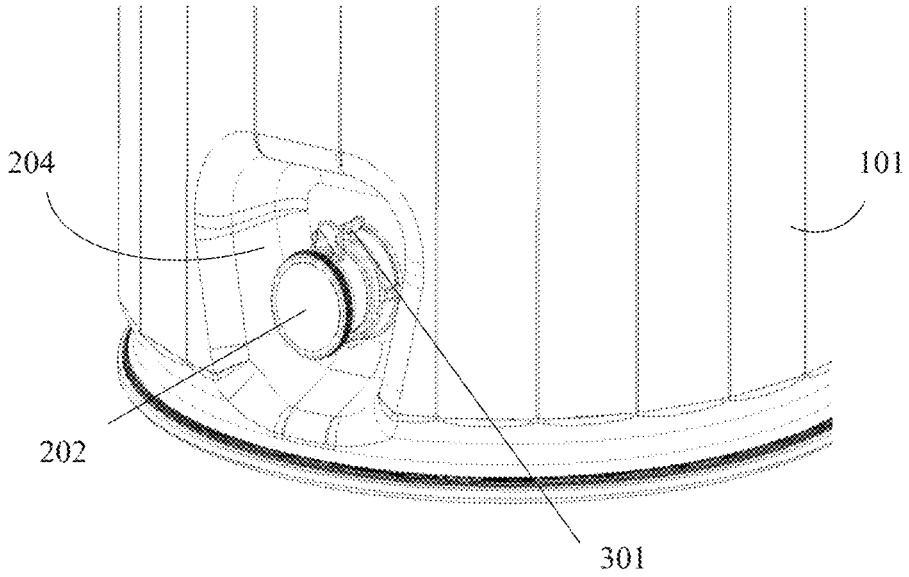
FIG. 3*a* illustrates a magnified perspective view of a discharge valve 202 of the polygonal shaped container 101, in accordance with an embodiment of the present subject matter.
Figure 3B:
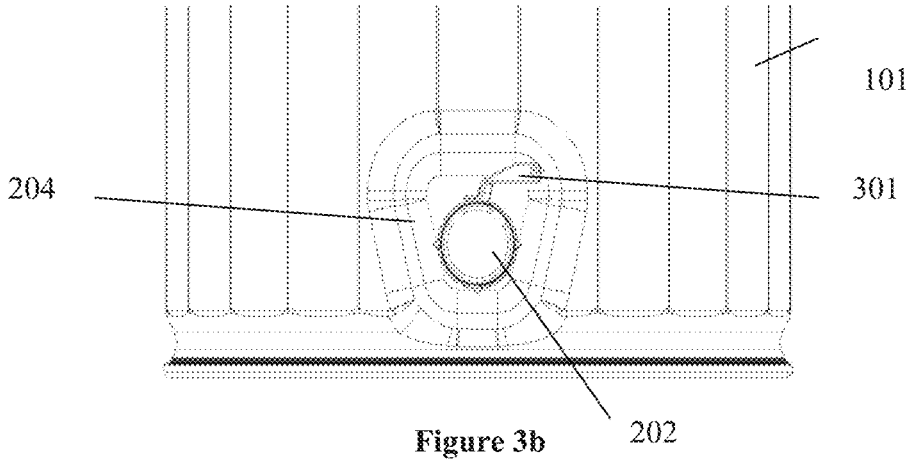
FIG. 3*b* illustrates a magnified front view of the discharge valve 202, in accordance with an embodiment of the present subject matter.

Referring now to FIG. 3*a* and FIG. 3*b*, a magnified perspective view and front view of the discharge valve is illustrated in accordance with an embodiment of the present subject matter. In one embodiment, at least one of the side walls 206 of the polygonal-shaped container 101 may further comprise a discharge valve 202. The discharge valve 202 may be fixed entirely within a cavity 204 formed on a lower surface 205 of said at least one of the side walls 206 such that lowest level of a fluid, contained in the polygonal-shaped container 101, may be discharged from the discharge valve 202. The polygonal-shaped container 101 may be capable of being rolled for portability. The rolling of the polygonal-shaped container 101 may be enabled due to the polygonal shape of the container 101 and the fixture of the discharge valve 202 entirely with the cavity 204 of at least one of the side walls. The discharge valve 202 may comprise an operating handle 301 enabled to start or stop flow of the fluid contained in the polygonal-shaped container 101. In one embodiment, the polygonal-shaped container 101 may be manufactured using a blow molding technique or rotational molding technique. The polygonal shaped container 101 may be inflammable.

The polygonal-shaped containers are economic, flexible, have high compressive strength, provide rollability, and are made of a material that are non-reactive with the material/fluid stored within the containers.

Referring now to FIG. 4 to FIG. 15, results of Finite Element Analysis (FEA) of the polygonal-shaped container 101 verifying the properties and compression on the polygonal-shaped container 101 are illustrated, in accordance with embodiments of the present subject matter. In one embodiment, the boundary conditions or the test criteria for the compression test may include, but not limited to, containers to be tested with all the openings plugged/closed, containers to be kept between the two plates, wherein the bottom plate may be fixed and top plate may be moving, the speed of compression may be 10 mm per minute, applying compression load till the deflection may be 30 mm from the start point. In one embodiment, assumptions considered for the compression test may further include, but not limited to, considering material and geometrical nonlinearity, extrapolation beyond extremes may be based on the last slope of the deformation, conceding a standalone container for analysis, carrying out analysis using Ansys software. Further, acceptance criteria for the test may include strain as permitted. In one embodiment, the material data for the compression test may comprise Marlex HXM TR-571S possessing Young's modulus: 1850 MPa (ASTM D638), Poisson ratio: typically, around 0.40-0.45, Density: 0.953 g/cm$^3$(ASTM D 1505), Yield stress: 27 MPa (ASTM D638).

Figure 4:
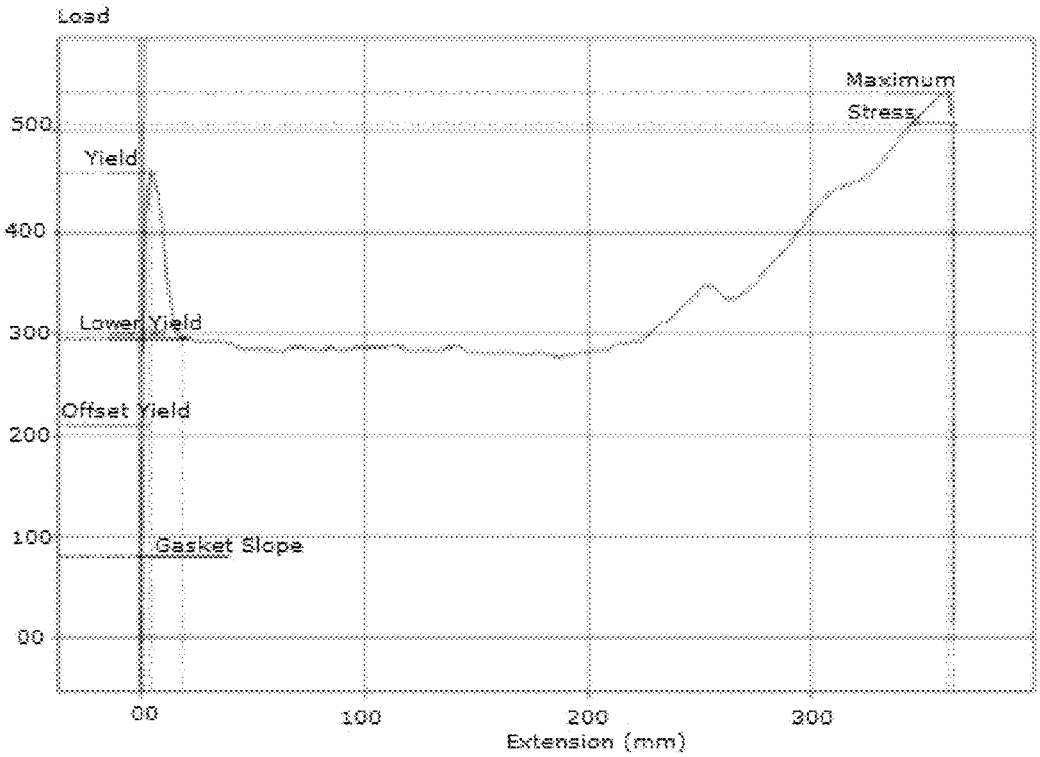
FIG. 4 illustrates a graph of stress strain curve for the polygonal-shaped container 101, in accordance with an embodiment of the present subject matter.

FIG. 4 illustrates a graph of stress strain curve of the polygonal-shaped container 101, in accordance with an embodiment of the present subject matter. The graph depicts load vs extension. The graph illustrates values of at least yield, lower yield, offset yield, greatest slope, break and maximum.

Figure 5:
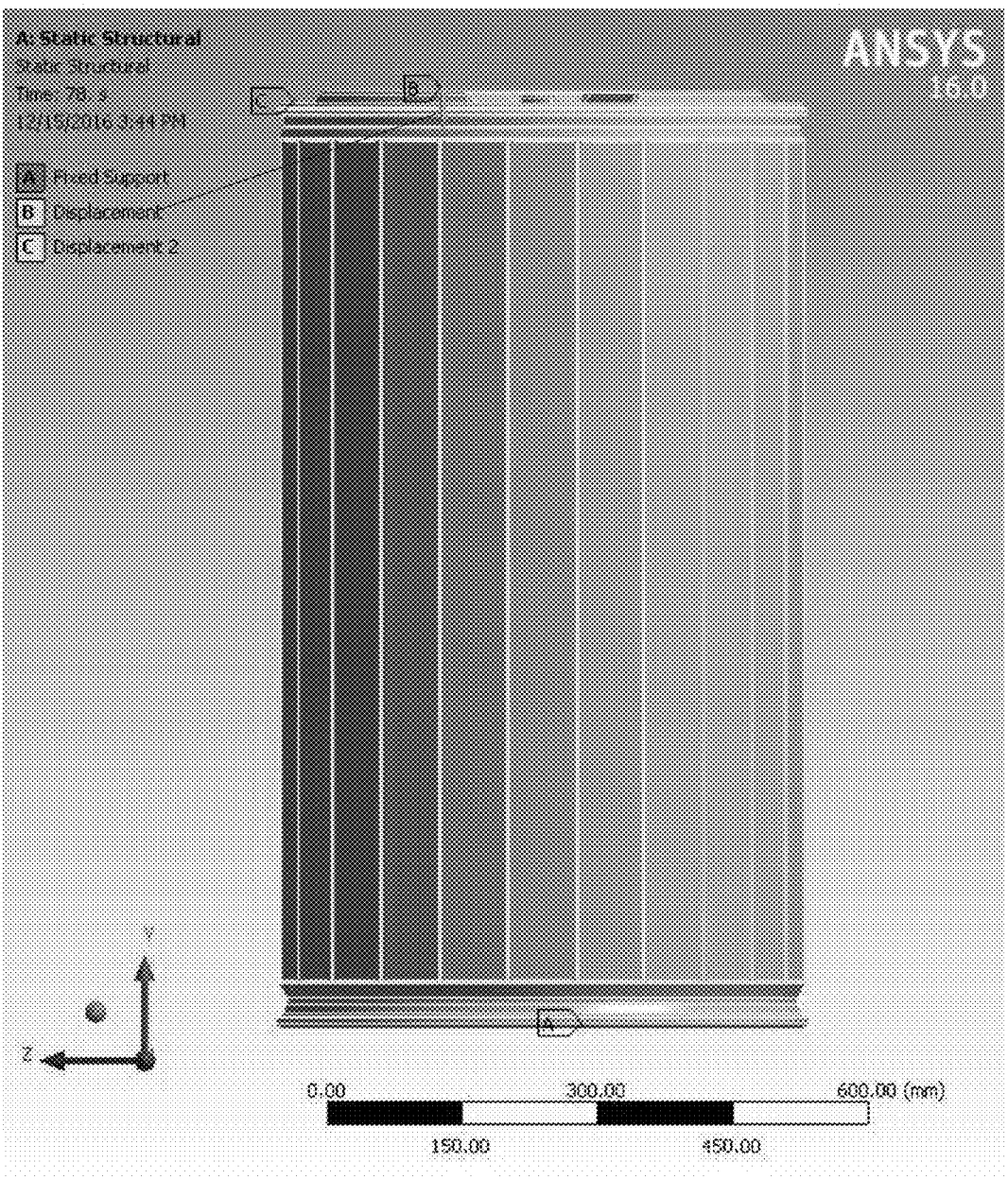
FIG. 5 illustrates boundary conditions for conducting compression test of the polygonal-shaped container 101, in accordance with an embodiment of the present subject matter.

FIG. 5 illustrates a boundary conditions for conducting compression test of the polygonal-shaped container 101, in accordance with an embodiment of the present subject matter. In one embodiment, FIG. 8 may comprise a fixed support, a displacement, and a displacement 2. The displacement may be observed (as indicated with an arrow directing to a yellow color in a scale depicted in left-half of FIG. 5). The observed displacement may be nearly 150 mm depicted on a scale at the bottom.

Figure 6:
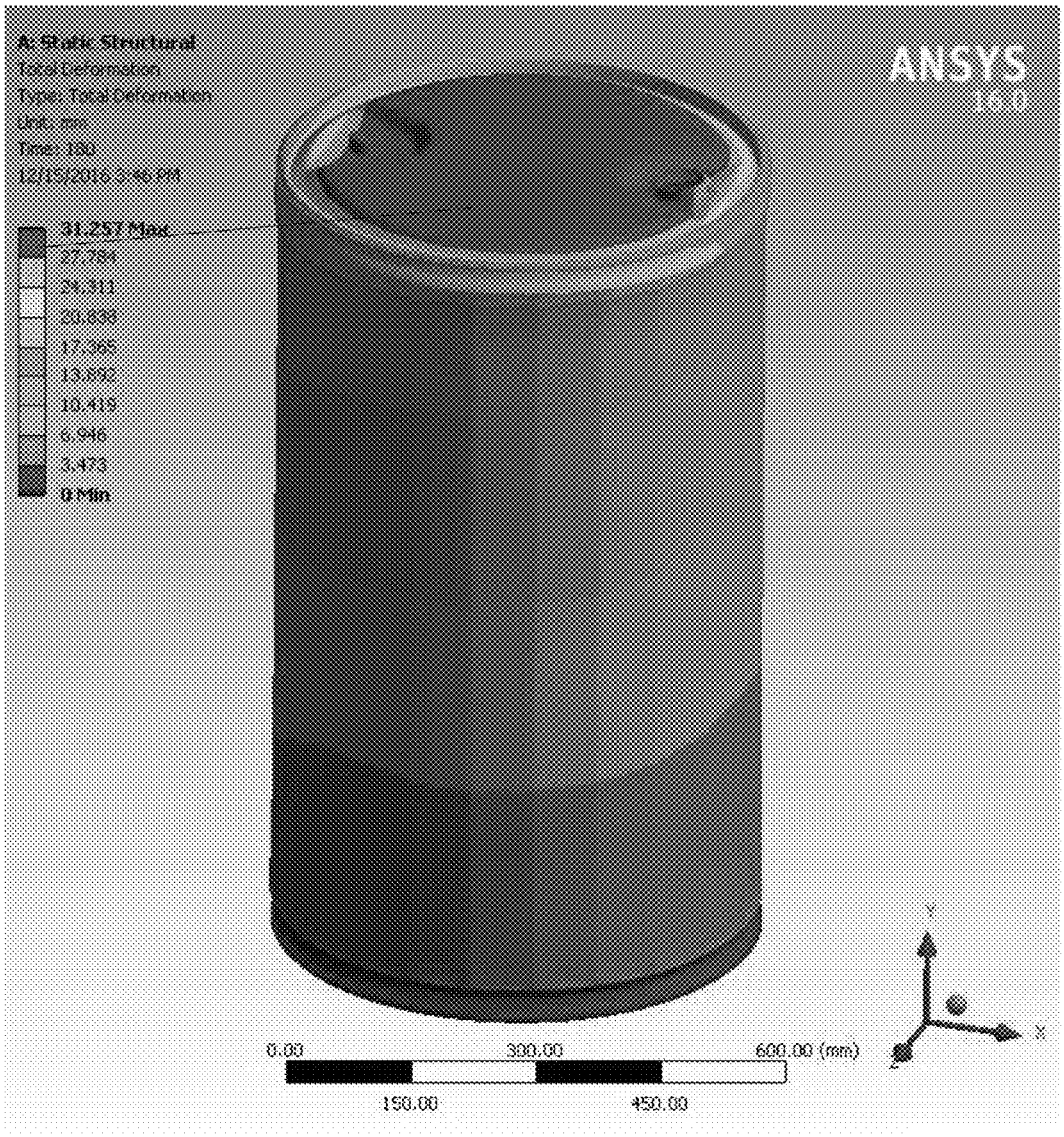
FIG. 6 illustrates a result of the compression test depicting deformation of the polygonal-shaped container 101, in accordance with an embodiment of the present subject matter.

FIG. 6 illustrates a result of the compression test depicting deformation of the polygonal-shaped container 101, in accordance with an embodiment of the present subject matter. In one embodiment, a maximum deformation of 31.257 may be observed. Further, various deformations (indicated with different colors as per the scale) at different portions of the container may be obtained as depicted.

Figure 7A:
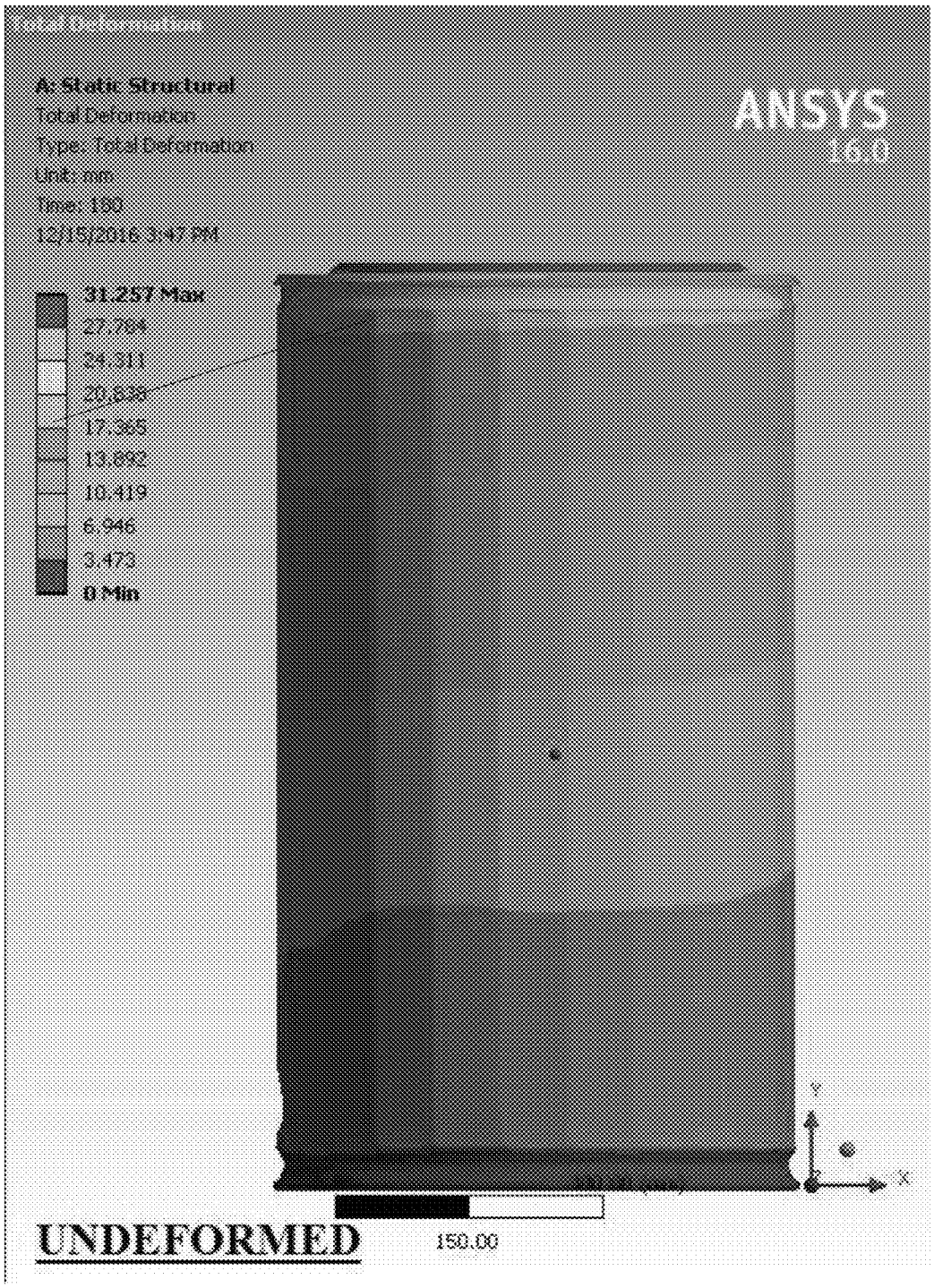
FIG. 7*a* and FIG. 7*b* illustrates a result of the compression test depicting un-deformed and deformed polygonal-shaped container 101, in accordance with an embodiment of the present subject matter.
Figure 7B:
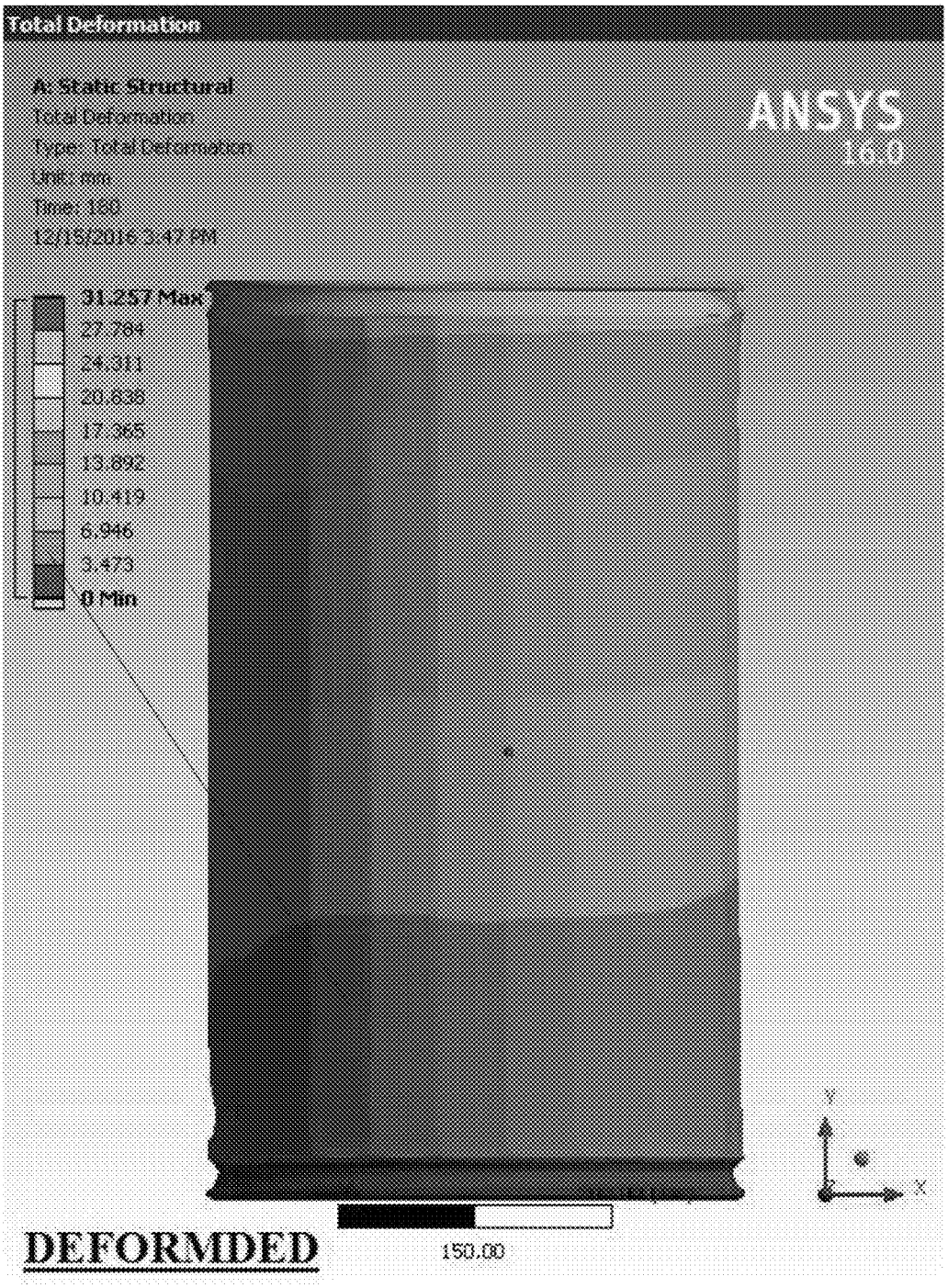

FIG. 7*a* and FIG. 7*b* illustrates a result of the compression test depicting un-deformed and deformed polygonal-shaped container 101, in accordance with an embodiment of the present subject matter. In one embodiment, the un-deformed and deformed container may be depicted (shown in two different halves of FIG. 7) of the polygonal-shaped container 101 having values of 17.365 and 3.473, respectively, may be obtained. Similarly, other values of the un-deformed and deformed container (indicated with different colors as per the scale) at different portions of the container may be obtained.

Figure 8:
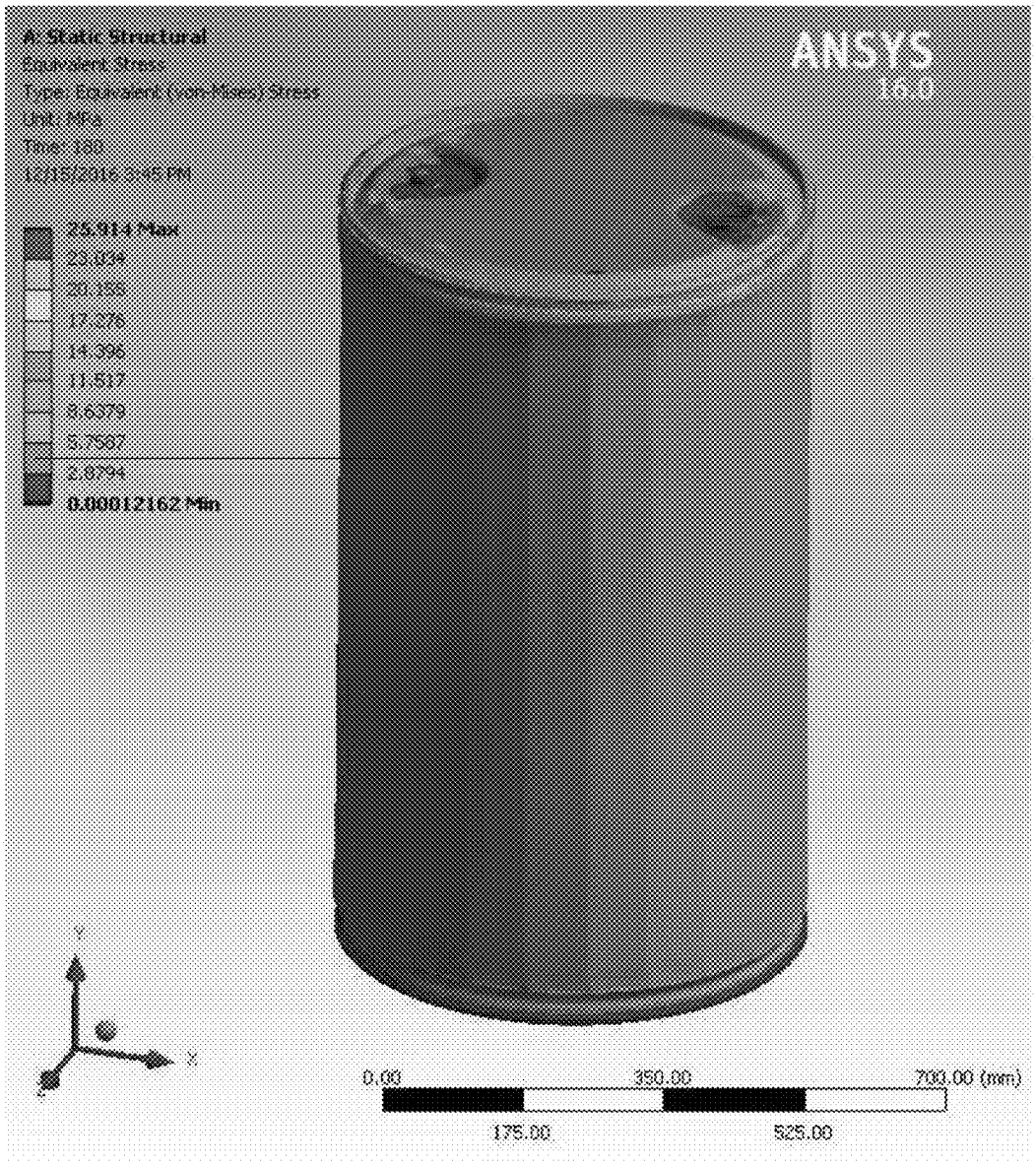
FIG. 8 illustrates a result of the compression test depicting stress in the polygonal-shaped container 101, in accordance with an embodiment of the present subject matter.

FIG. 8 illustrates a result of the compression test depicting stress in the polygonal-shaped container 101, in accordance with an embodiment of the present subject matter. In one embodiment, a stress level of 2.8794 may be obtained as depicted with an arrow to one of the colors in the scale. Further stress levels (indicated with different colors as per the scale) pertaining to different sections of the container may be obtained.

Figure 9:
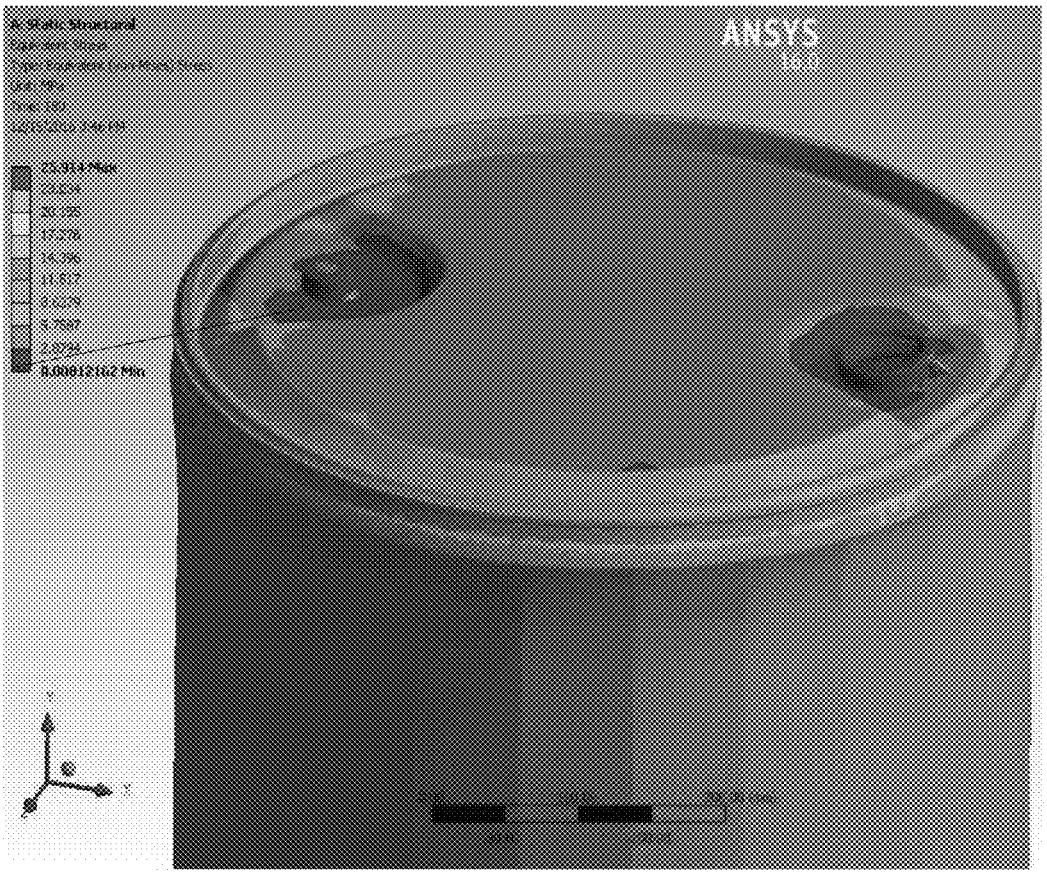
FIG. 9 illustrates a result of the compression test depicting stress in the magnified view of polygonal-shaped container 101, in accordance with an embodiment of the present subject matter.

FIG. 9 illustrates a result of the compression test depicting stress in the magnified view of polygonal-shaped container 101, in accordance with an embodiment of the present subject matter. In one embodiment, a stress level within a range between 0.00012162 (minimum stress level) to 25.914 (maximum stress level) pertaining to different sections of the container may be obtained as indicated with different colors as per the scale.

Figure 10:
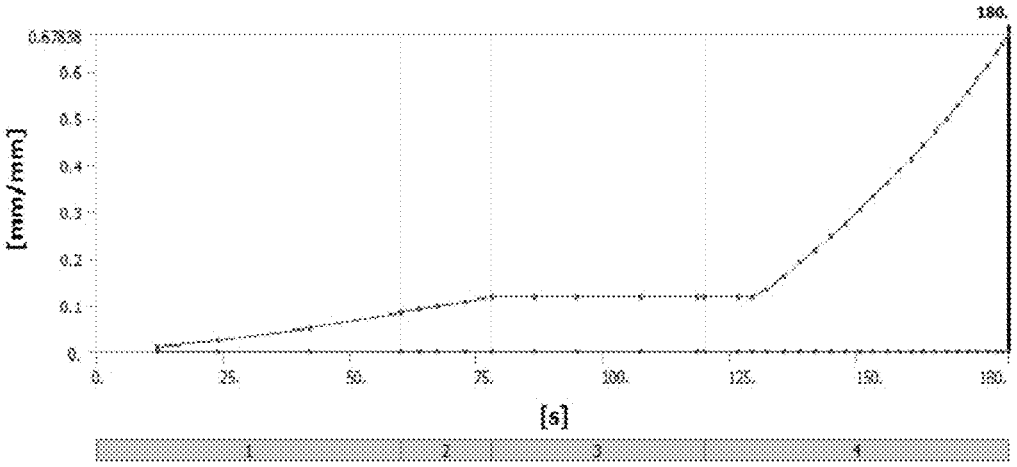
FIG. 10 illustrates a graph of plastic strain of the polygonal-shaped container 101, in accordance with an embodiment of the present subject matter.

FIG. 10 illustrates a graph of plastic strain of the polygonal-shaped container 101, in accordance with an embodiment of the present subject matter. The graph depicts Y axis having values (indicating plastic strain) ranging from 0 to 0.67838 mm/mm and X axis having values (time) ranging from 0 to 180s. A maximum value of 0.67838 mm/mm plastic strain is observed at 180s.

Figure 11A:
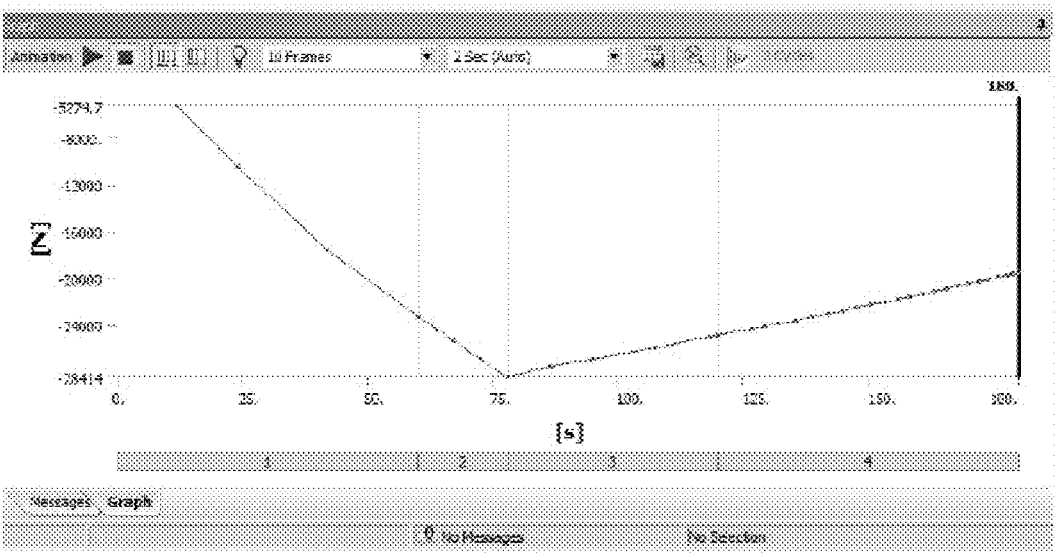
FIG. 11*a* and FIG. 11*b* illustrates graphs and pictorial representations of force reaction of the polygonal-shaped container 101, in accordance with an embodiment of the present subject matter.
Figure 11A:
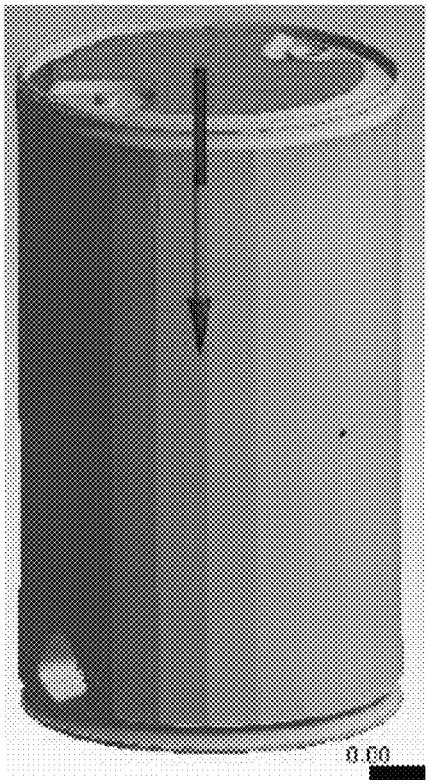
Figure 11B:
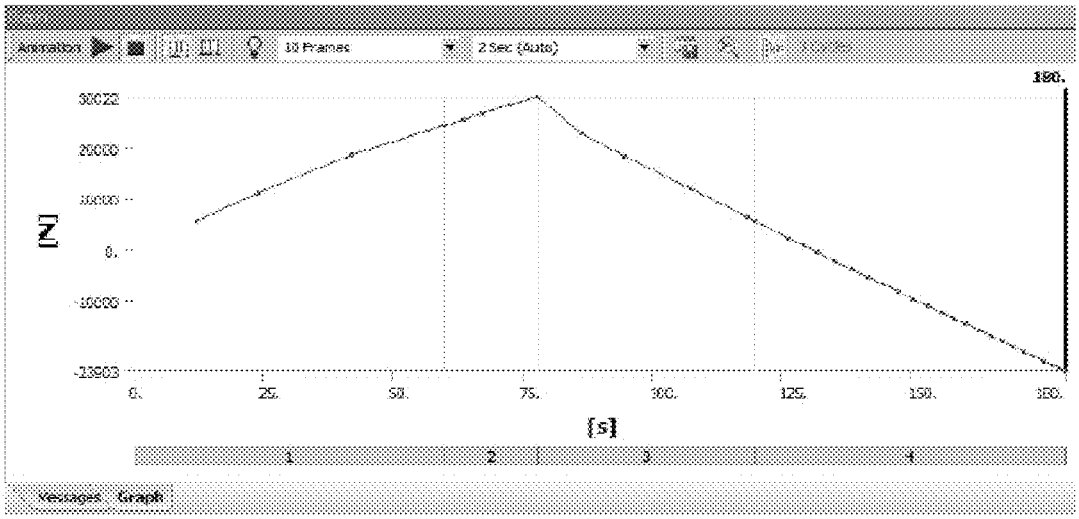
Figure 11B:
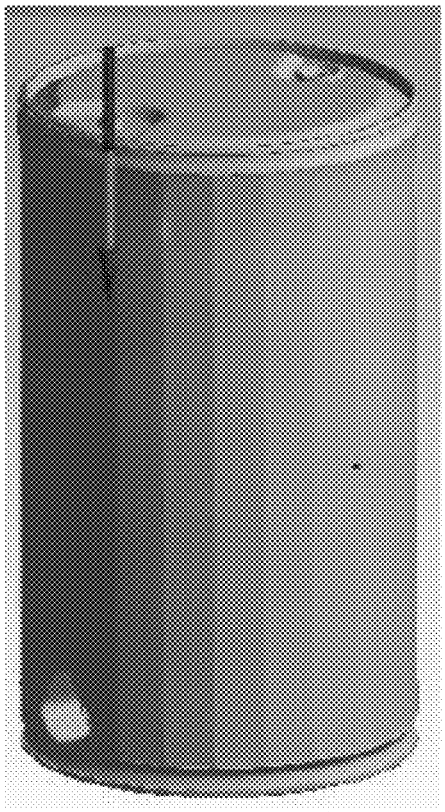

FIG. 11*a* and FIG. 11*b* illustrates graphs and pictorial representations of force reaction of the polygonal-shaped container 101, in accordance with an embodiment of the present subject matter. The force reaction may act downwards. The first graph shows Y axis having values (indicating force) ranging from −28414 to −5274.7 N and X axis having values (indicating time) ranging from 0 to 180s. A minimum value of the force is observed within time span of 75-100s. The second graph shows Y axis having values (indicating force) ranging from −23903 to 30022 N and X axis having values ranging from 0 to 180s (indicating time). A maximum value of the force is observed within time span of 75-100s.

Figure 12A:
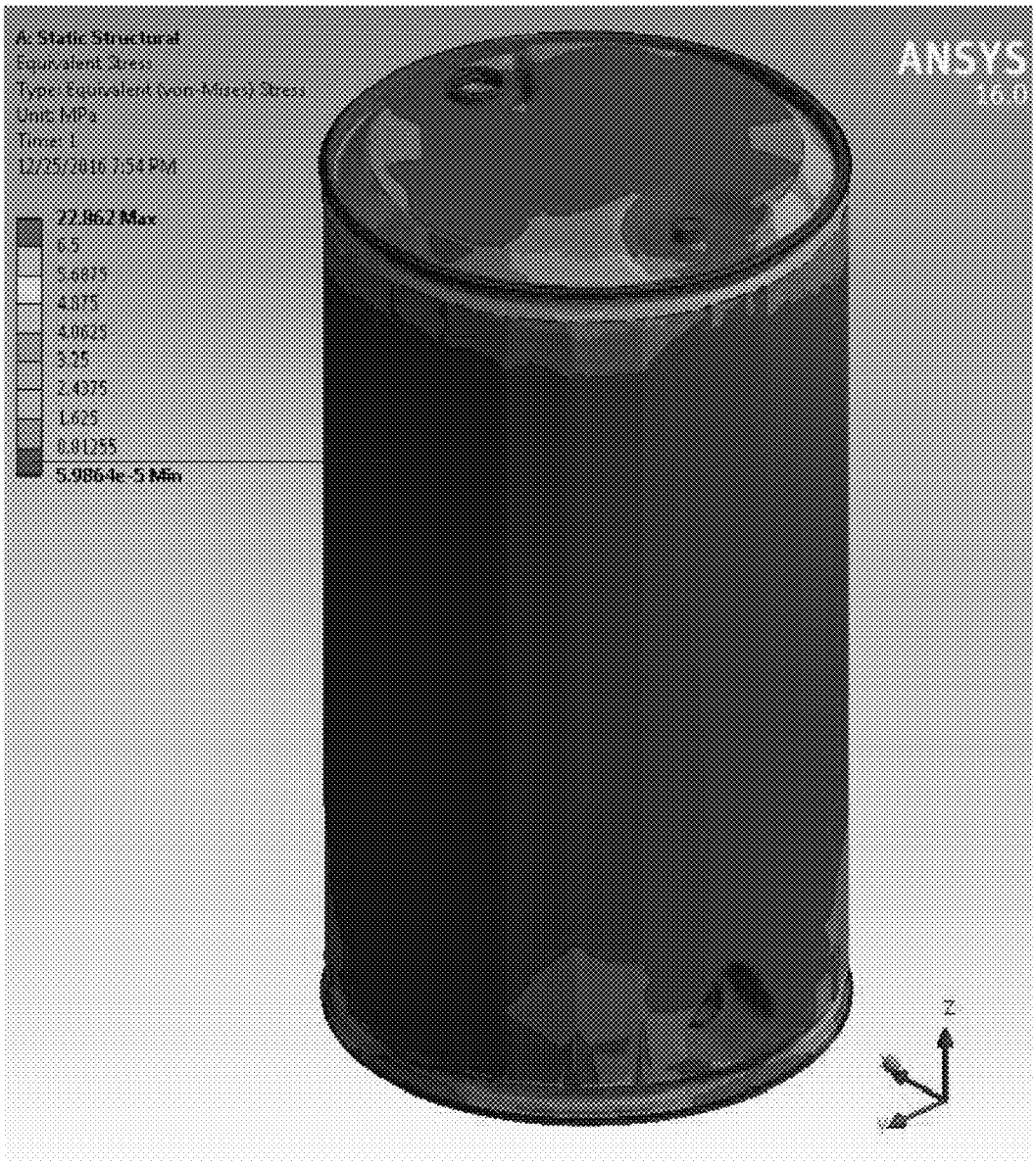
FIG. 12*a* and FIG. 12*b* illustrates a result of the stacking test analysis depicting maximum stress of the lower drum, in accordance with an embodiment of the present subject matter.
Figure 12B:
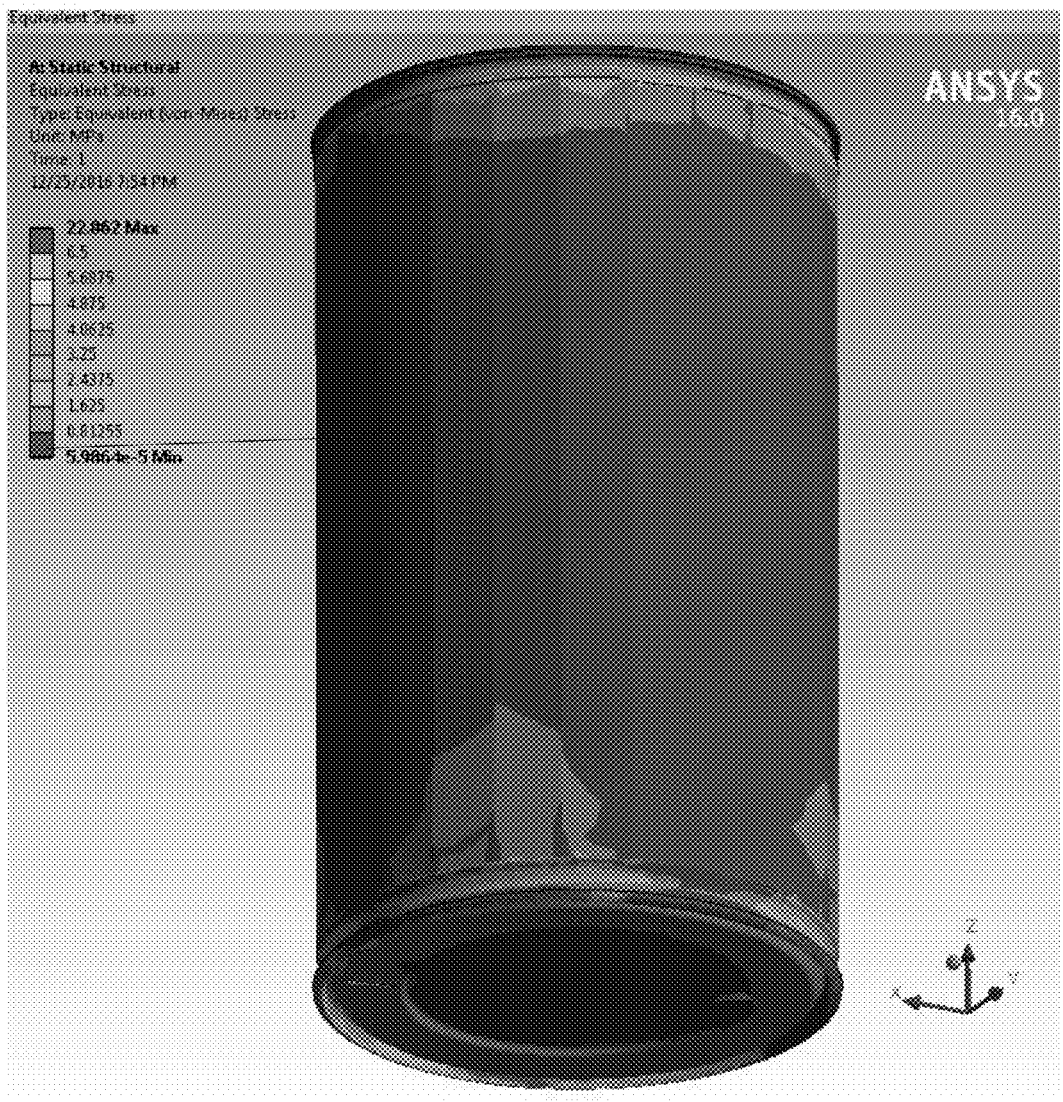

FIG. 12*a* and FIG. 12*b* illustrates a result of the stacking test analysis depicting maximum stress of a lower drum stacked with an upper drum, in accordance with an embodiment of the present subject matter. In one embodiment, a stress level of 5.9864e-5 may be obtained pertaining to two different sections of the lower drum. Similarly, stress level for the other sections of the lower drum may be observed. A maximum stress of 22.86 may be obtained on the lower drum.

Figure 13A:
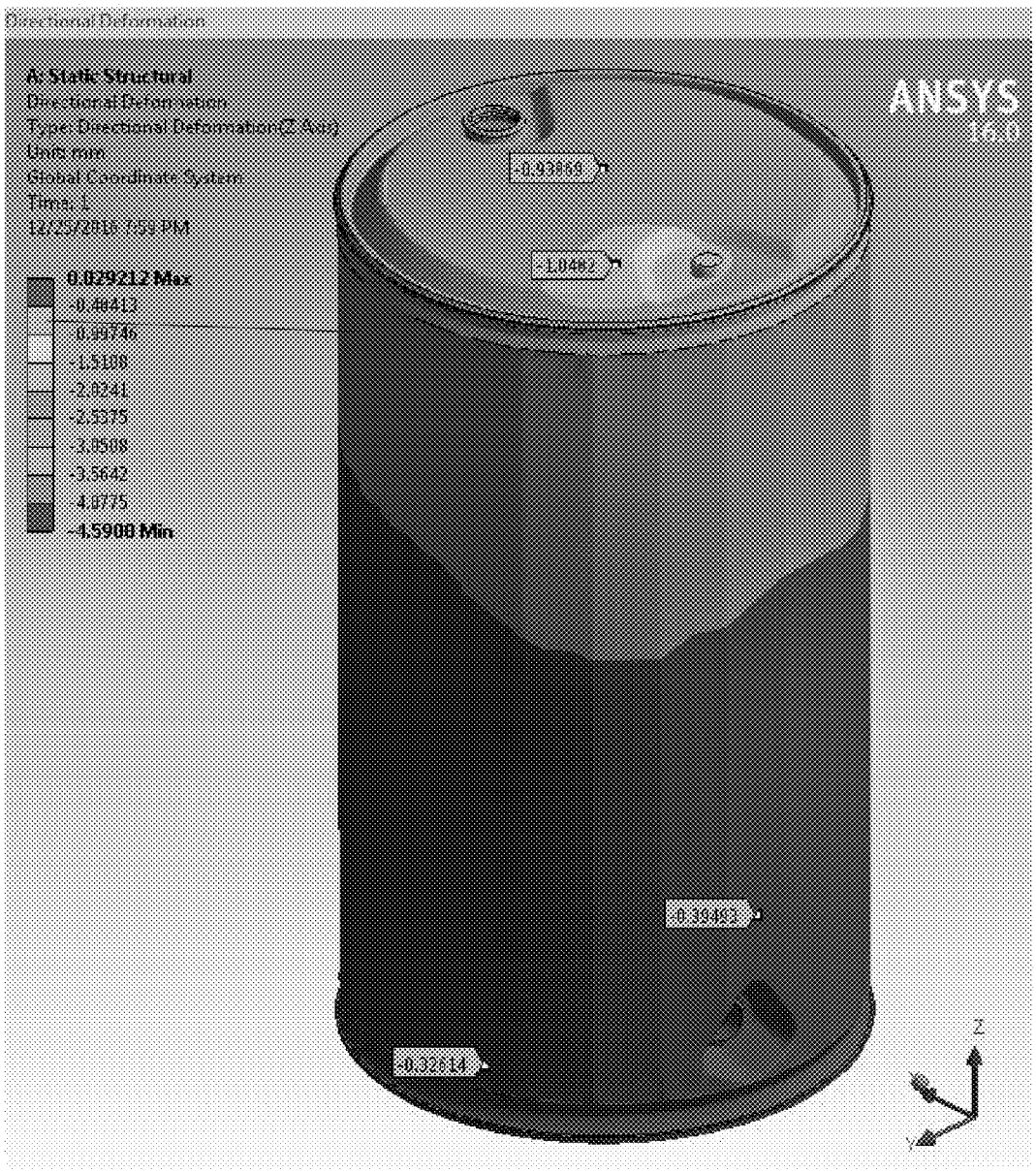
FIG. 13*a* and FIG. 13*b* illustrates a result of the stacking test analysis depicting deformation of the lower drum, in accordance with an embodiment of the present subject matter.
Figure 13B:
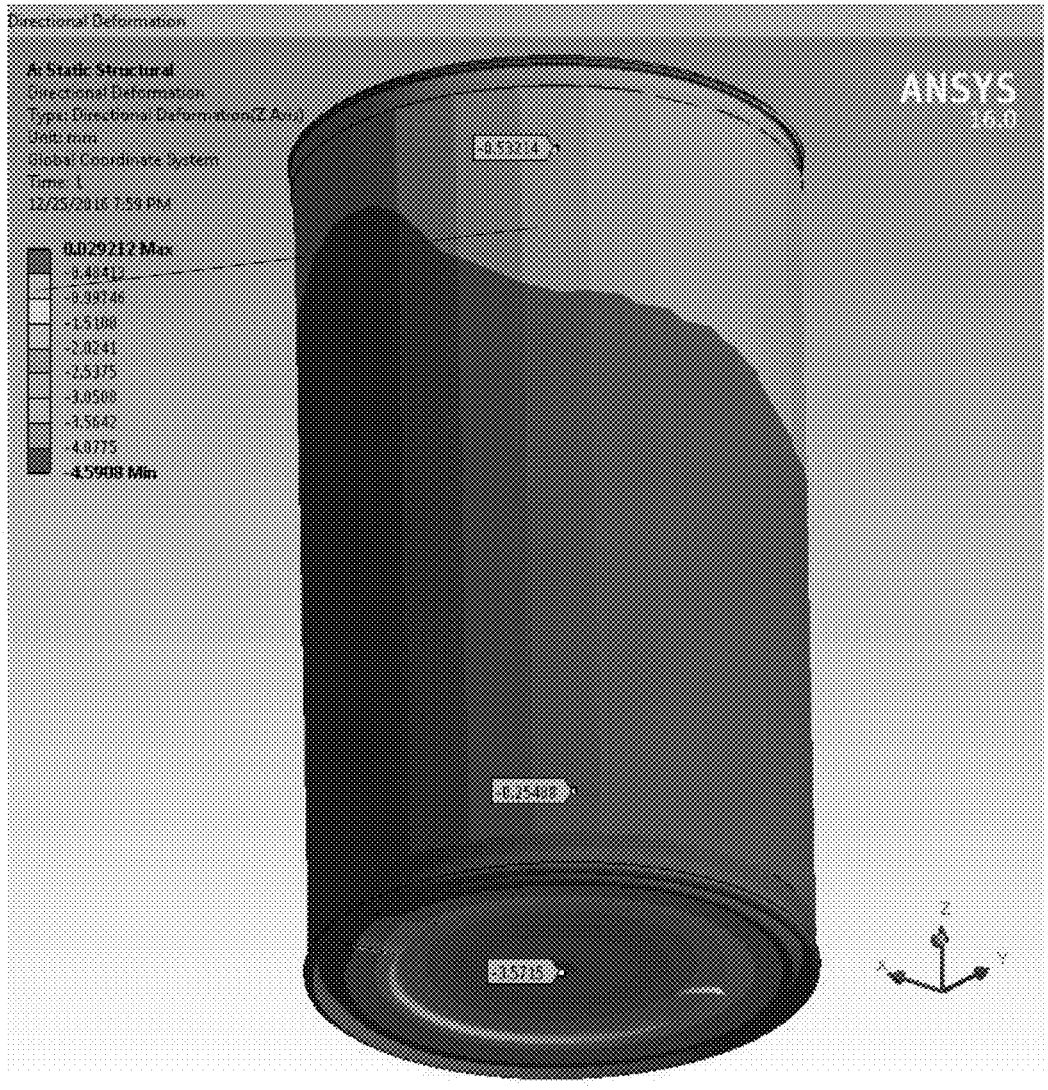

FIG. 13*a* and FIG. 13*b* illustrates a result of the stacking test analysis depicting deformation of the lower drum stacked with the upper drum, in accordance with an embodiment of the present subject matter. In one embodiment, a deformation of −0.48413 may be obtained pertaining to two different sections of the lower drum. Similarly, deformations for the other sections of the lower drum may be observed. A deformation of 1.04 mm may be obtained on the lower drum.

Figure 14A:
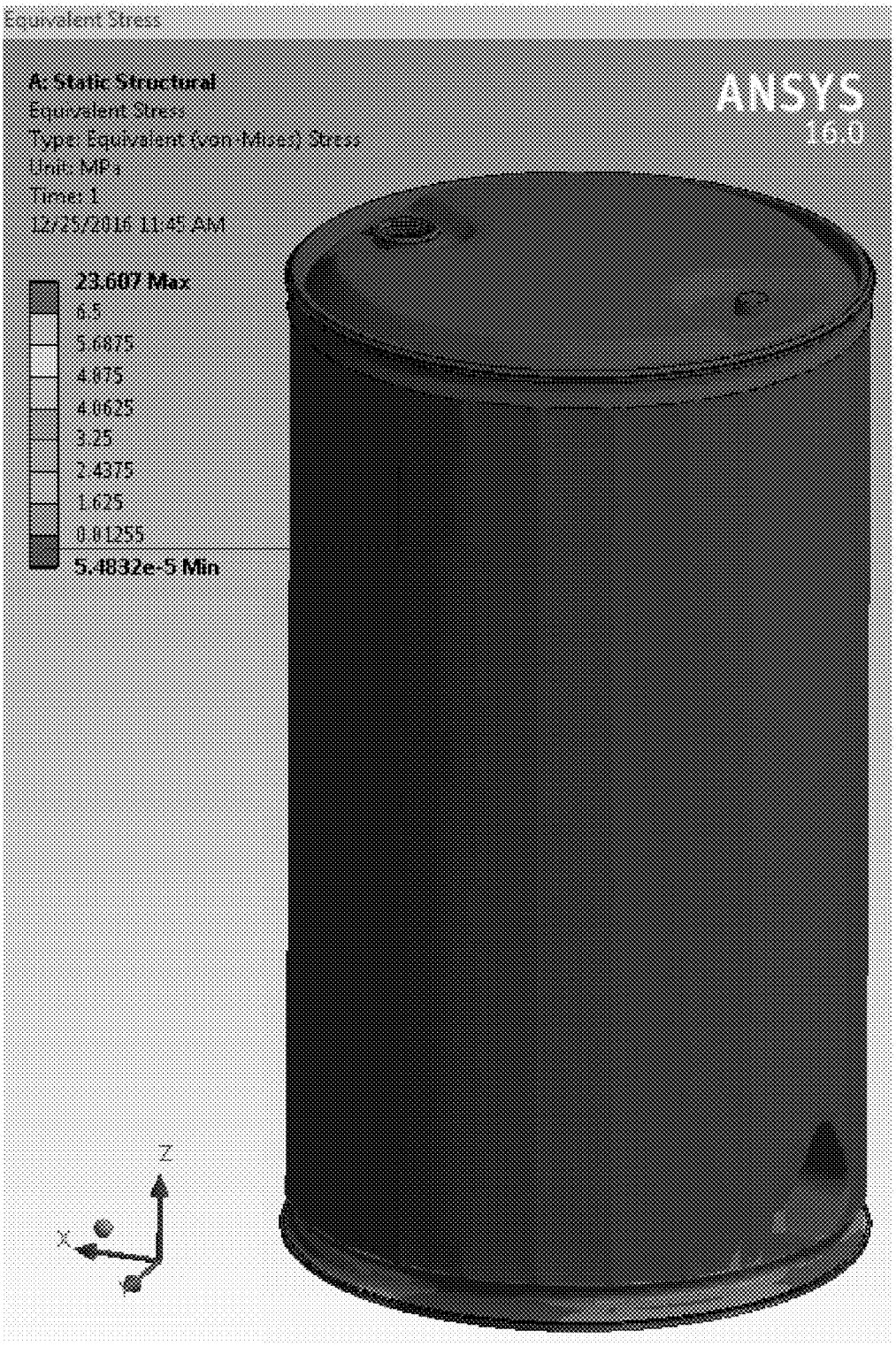
FIG. 14*a* and FIG. 14*b* illustrates a result of the stacking test analysis depicting maximum stress of the upper drum, in accordance with an embodiment of the present subject matter.
Figure 14B:
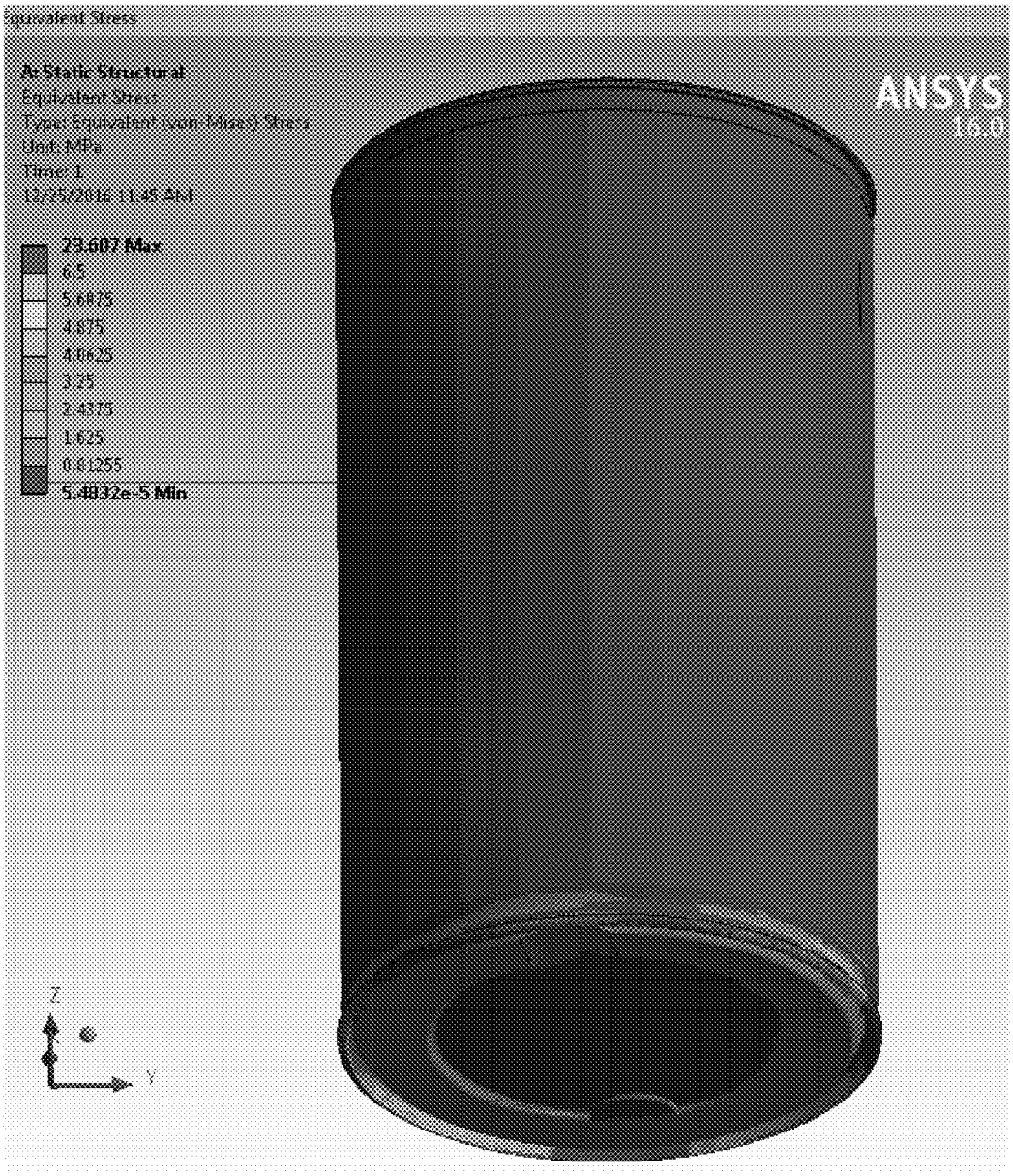

FIG. 14*a* and FIG. 14*b* illustrates a result of the stacking test analysis depicting maximum stress of the upper drum stacked with the lower drum, in accordance with an embodiment of the present subject matter. In one embodiment, a stress level of 5.9864e-5 may be obtained pertaining to two different sections of the upper drum. Similarly, stress levels for the other sections of the upper drum may be observed. A maximum of 22.86 Mpa may be obtained on the upper drum.

Figure 15A:
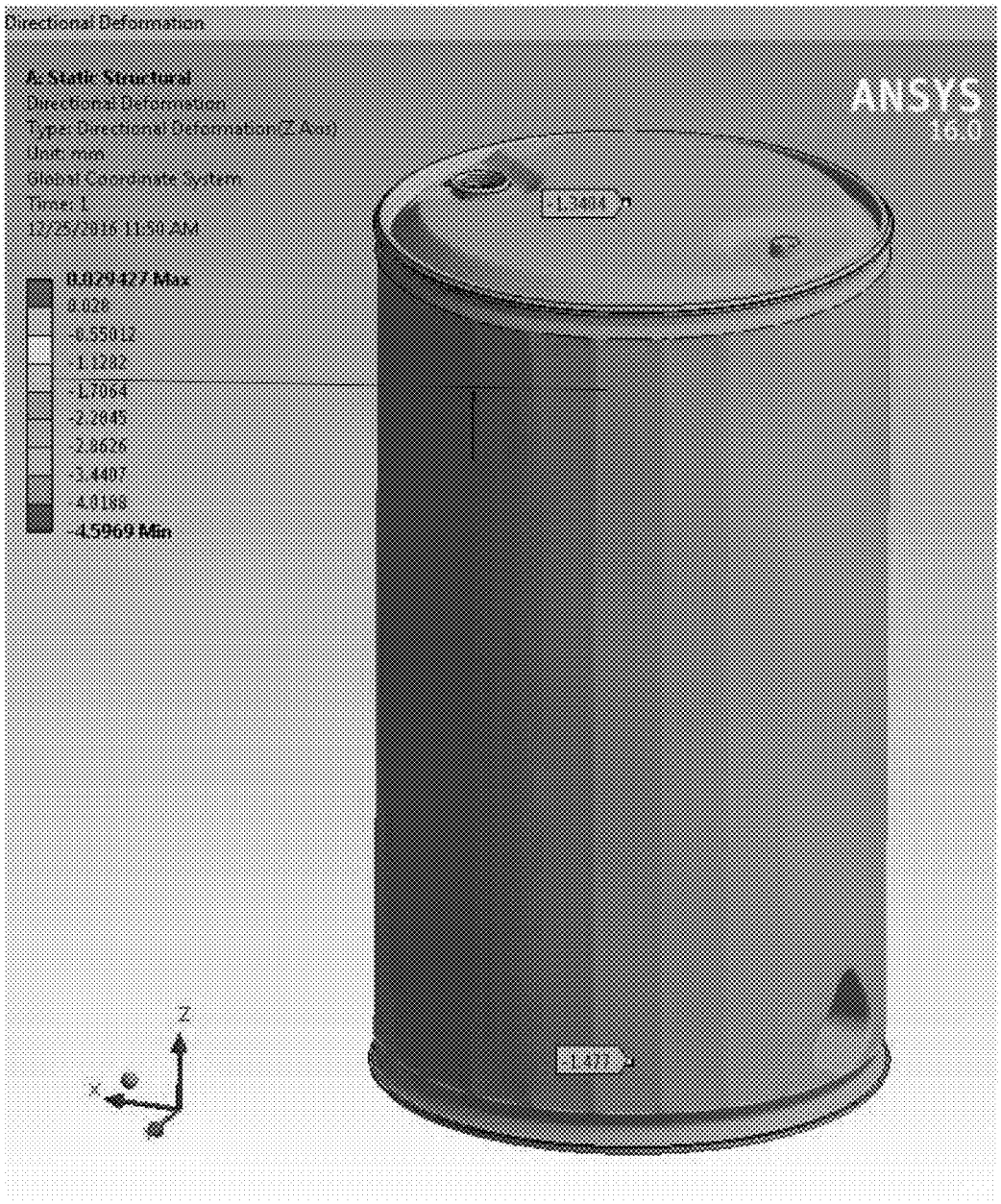
FIG. 15*a* and FIG. 15*b* illustrates a result of the stacking test analysis depicting deformation of the upper drum, in accordance with an embodiment of the present subject matter.
Figure 15B:
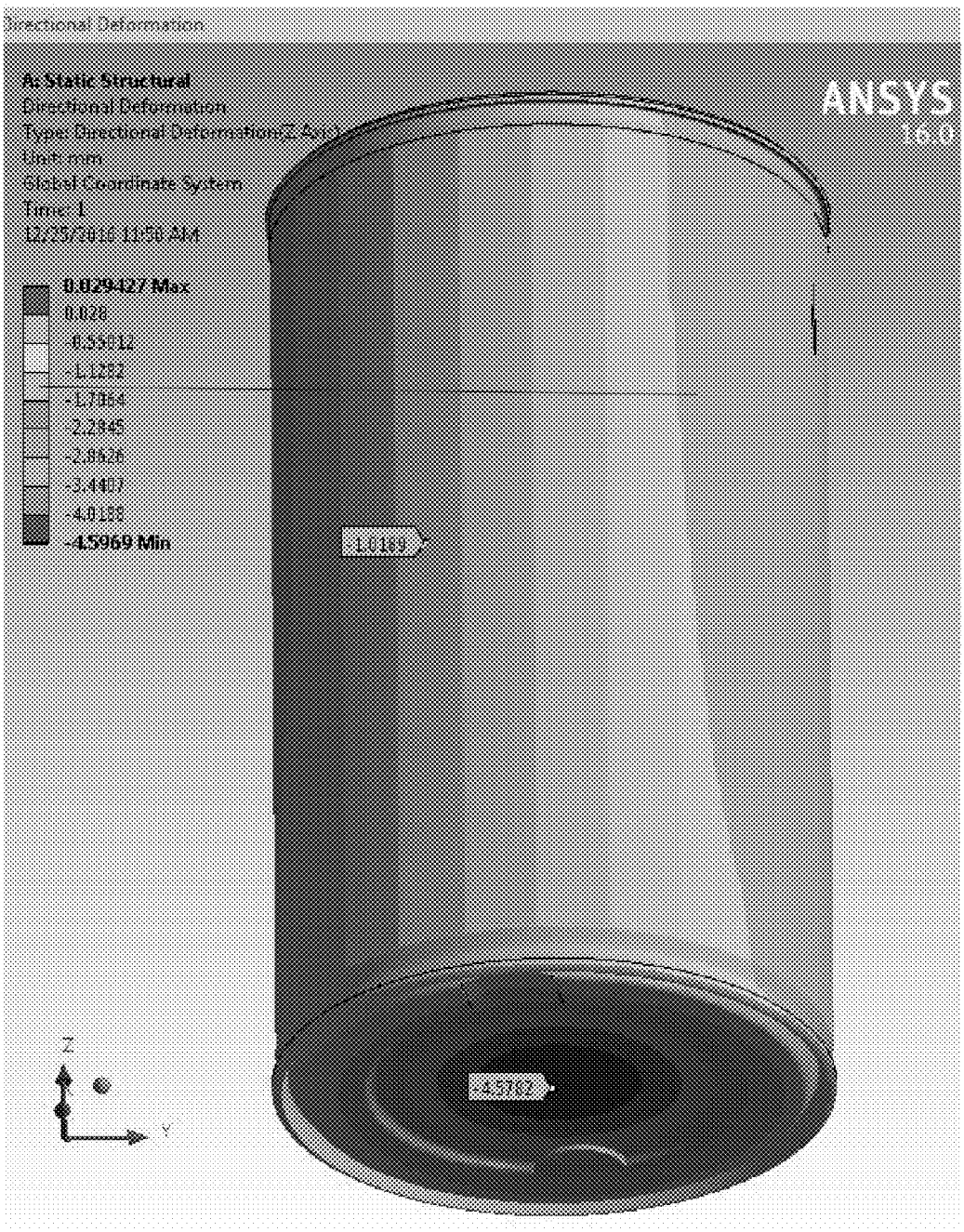

FIG. 15*a* and FIG. 15*b* illustrates a result of the stacking test analysis depicting deformation of the upper drum stacked with the lower drum, in accordance with an embodiment of the present subject matter. In one embodiment, a deformation of −1.1282 may be obtained pertaining to two different sections of the upper drum. Similarly, deformations for the other sections of the upper drum may be observed. A deformation of 4.56 mm may be obtained on the upper drum.

The aforementioned characteristics of the polygonal-shaped drum 101 observed based upon the test results is summarized in the comparison table below comparing the characteristics of the polygonal-shaped drum 101 with the conventional round container (drum).

TABLE 1

Test result Analysis of Polygonal Shaped Container/Drum vis-à-vis Round drum

| Test Parameter | Round Drum | Polygonal Shaped Container/Drum |
|---|---|---|
| Stress | 25.74 MPa | 25.91 MPa |
| Plastic Strain | 0.29 | 0.67 |
| Force Reaction | 46961 N | 30022 N |
| Deformation | 32.06 mm | 31.25 mm |

As can be observed from Table 1, for the same amount of deformation both the round drum and the polygonal-shaped drum 101 exhibit similar stress value.

However, the polygonal-shaped drum 101 has more induced strain (almost twice) as compared to the round drum. Further, there is large variation in the amount of force required to deform the polygonal-shaped drum 101 as compared to that required for deforming the round drum. Further, it can be observed that the round drum has more capacity to withstand the load as compared to the polygonal-shaped drum 101.

Although implementations of a polygonal shaped container have been described in language specific to structural features and/or methods, it is to be understood that the appended claims are not necessarily limited to the specific features or methods described. Rather, the specific features are disclosed as examples of the polygonal shaped container.

The invention claimed is:

1. A polygonal-shaped container (101), wherein the polygonal-shaped container (101) comprises a top surface (105), a bottom surface (203), and a plurality of side walls (206), wherein each edge (201, 203) connecting two side walls is filled with additional reinforcement material, wherein the additional reinforcement material along with the polygonal shape of the polygonal-shaped container (101) facilitates in enhancing compressive strength of the polygonal-shaped container (101), and wherein at least one of the side walls (206) further comprises a discharge valve (202) fixed entirely within a cavity (204) formed on a lower surface of said one of the side walls (206) such that lowest level of a fluid, contained in the polygonal-shaped container (101), is discharged from the discharge valve (202), wherein the polygonal-shaped container (101) is capable of being rolled for portability, wherein the polygonal-shaped container (101) comprises an outer L ring (104) on the top surface (105) and bottom surface (203) of the polygonal-shaped containers wherein, said outer L ring enables stackability of multiple containers, facilitated by holding a bottom surface of an upper container having properties identical to the said polygonal-shaped container (101), and wherein the bottom surface (205) of the polygonal-shaped container (101) is adapted to be supported on a top surface of a lower container having properties identical to the said polygonal-shaped container (101).

2. The polygonal-shaped container (101) of claim 1, wherein the polygonal-shaped container (101) is adapted to store hazardous, non-touchable or flammable fluids.

3. The polygonal-shaped container (101) of claim 2, wherein the discharge valve (202) comprises an operating handle (301) enabled to start or stop flow of the fluid contained in the polygonal-shaped container (101).

4. The polygonal-shaped container (101) of claim 3, wherein the polygonal-shaped container (101) further comprises at least one inlet (102) and at least one opening (103) on the top surface (105), wherein said inlet (102) is capable of receiving the fluid to be filled in the polygonal-shaped container (101), and wherein at least one opening (103) is capable of enabling discharging of the fluid from the polygonal-shaped container (101).

5. The polygonal-shaped container (101) of claim 4, wherein the polygonal-shaped container (101) is made of a polymer material.

6. The polygonal-shaped container (101) of claim 5, wherein the additional reinforcement material is at least a polymer material.

7. The polygonal-shaped container (101) of claim 6, wherein the additional reinforcement material is adapted to extend from edge (201) of the upper surface to the edge (203) of the bottom surface of the polygonal-shaped container (101).

8. The polygonal-shaped container (101) of claim 1, wherein the polygonal-shaped container (101) has an inner circular shape that facilitates easy cleaning of the inner portion of the polygonal-shaped container (101).

* * * * *